US009731950B2

(12) United States Patent
Yamada et al.

(10) Patent No.: US 9,731,950 B2
(45) Date of Patent: Aug. 15, 2017

(54) APPARATUS FOR CONTROLLING LOAD HANDLING DEVICE

(71) Applicant: KABUSHIKI KAISHA TOYOTA JIDOSHOKKI, Kariya-shi, Aichi-ken (JP)

(72) Inventors: Tadashi Yamada, Aichi-ken (JP); Takashi Nishiwaki, Aichi-ken (JP); Junichi Kuwayama, Aichi-ken (JP); Hidenori Oka, Aichi-ken (JP); Kimihide Hasegawa, Aichi-ken (JP); Hiroshi Murata, Aichi-ken (JP)

(73) Assignee: KABUSHIKI KAISHA TOYOTA JIDOSHOKKI, Kariya-shi (JP)

( * ) Notice: Subject to any disclaimer, the term of this patent is extended or adjusted under 35 U.S.C. 154(b) by 0 days.

(21) Appl. No.: 14/859,663

(22) Filed: Sep. 21, 2015

(65) Prior Publication Data

US 2016/0083233 A1 Mar. 24, 2016

(30) Foreign Application Priority Data

Sep. 22, 2014 (JP) ..... 2014-192497

(51) Int. Cl.

| | |
|---|---|
| ***B66F 9/12*** | (2006.01) |
| ***B66F 9/22*** | (2006.01) |
| ***B66F 17/00*** | (2006.01) |
| ***B66F 9/075*** | (2006.01) |

(52) U.S. Cl.

CPC ..... *B66F 9/22* (2013.01); *B66F 9/07568* (2013.01); *B66F 17/003* (2013.01)

(58) Field of Classification Search

USPC ..... 414/664

See application file for complete search history.

(56) References Cited

FOREIGN PATENT DOCUMENTS

| | | | |
|---|---|---|---|
| DE | 10 2010 055746 | A1 | 6/2012 |
| EP | 2 574 589 | A1 | 4/2013 |
| GB | 2 099 184 | A | 12/1982 |
| JP | 2014-108877 | A | 6/2014 |

OTHER PUBLICATIONS

European Patent Office Communication dated Feb. 18, 2016 in Appln. No. 15185843.8.

*Primary Examiner* — Saul Rodriguez
*Assistant Examiner* — Willie Berry, Jr.
(74) *Attorney, Agent, or Firm* — Sughrue Mion, PLLC

(57) ABSTRACT

An apparatus for controlling a load handling device of an industrial vehicle includes a lifted height detector that detects a lifted height of the load handling device, a tilt angle detector that detects a tilt angle of the load handling device, a loading pump that pumps hydraulic oil from a hydraulic tank in the industrial vehicle and supplies the hydraulic oil to a lift cylinder and a tilt cylinder, a drive that drives the loading pump, and a controller that controls the flow rate of hydraulic oil supplied to the lift cylinder and the tilt cylinder. When the forward tilt angle of the load handling device is greater than a first regulation tilt angle and a lifted height of the load handling device is higher than a predetermined reference height, the controller regulates the flow rate of hydraulic oil supplied to the lift cylinder.

10 Claims, 5 Drawing Sheets

APPARATUS FOR CONTROLLING LOAD HANDLING DEVICE

BACKGROUND OF THE INVENTION

The present invention relates to an apparatus for controlling a load handling device of an industrial vehicle.

Forklift trucks have been widely used as an industrial vehicle that performs load handling operations (loading and unloading of a load) in a warehouse. Japanese Unexamined Patent Application Publication No. 2014-108877 discloses an example of such forklift truck. In this type of forklift truck, the forks are lifted and lowered with the lift bracket by the mast assembly provided in the front of a vehicle body. The lifting and lowering of the forks is accomplished by extension and retraction of a hydraulic cylinder that is controlled by a lift lever. The mast assembly is tiltable forward and backward by a tilt cylinder that is controlled by a tilt lever.

Operation of tilting the mast assembly forward and lifting the forks having thereon a load may affect the operational stability of the forklift truck.

In order to prevent such unfavorable operation, it is preferable to warn an operator of the forklift truck beforehand that such tilting and lifting operation of the loaded forklift truck is not a normal operation. The present invention is directed to an apparatus for controlling a load handling device that is configured to warn an operator of a forklift truck that operation of the forklift truck may affect the operational stability of the forklift truck, i.e., the operator is warned of a potentially hazardous situation.

SUMMARY OF THE INVENTION

In accordance with an aspect of the present invention, there is provided an apparatus for controlling a load handling device of an industrial vehicle including with a lift cylinder and a tilt cylinder. The lift cylinder is supplied with hydraulic oil at a flow rate determined by an operation amount of a lift lever as a load handling lever and lifts and lowers the load handling device at a speed determined by the flow rate of hydraulic oil supplied to the lift cylinder. The tilt cylinder is supplied with hydraulic oil at a flow rate determined by an operation amount of a tilt lever as a load handling lever and tilts the load handling device at a speed determined by the flow rate of hydraulic oil supplied to the tilt cylinder. The apparatus for controlling the load handling device controls the supply of hydraulic oil to the lift cylinder and the tilt cylinder. The apparatus for controlling the load handling device includes a lifted height detector that detects a lifted height of the load handling device, a tilt angle detector that detects a tilt angle of the load handling device, a loading pump that pumps hydraulic oil from a hydraulic tank provided in the industrial vehicle and supplies the hydraulic oil to the lift cylinder and the tilt cylinder, a drive that drives the loading pump, and a controller that controls the flow rate of hydraulic oil that is supplied to the lift cylinder and the tilt cylinder. When the forward tilt angle of the load handling device is greater than a first regulation tilt angle and a lifted height of the load handling device is higher than a predetermined reference height, the controller regulates the flow rate of hydraulic oil supplied to the lift cylinder.

According to the first aspect of the present invention, when the load handling device tilted forward at an angle that is greater than the first regulation tilt angle is lifted higher than the reference height with the load handling device being tilted forward at an angle greater than the first regulation tilt angle, the flow rate of hydraulic oil supplied to the lift cylinder to thereby regulate the speed of lifting the load handling device. Therefore, when the operator of an industrial vehicle operates to lift the load handling device that is tilted forward at the angle greater than the first regulation tilt angle higher than the reference height, the lifting speed of the load handling device is reduced. Recognizing the reduction of the lifting speed of the load handling device, the operator can be informed of a potential instability of the industrial vehicle.

Other aspects and advantages of the invention will become apparent from the following description, taken in conjunction with the accompanying drawings, illustrating by way of example the principles of the invention.

DETAILED DESCRIPTION OF THE EMBODIMENTS

First Embodiment

Figure 1:
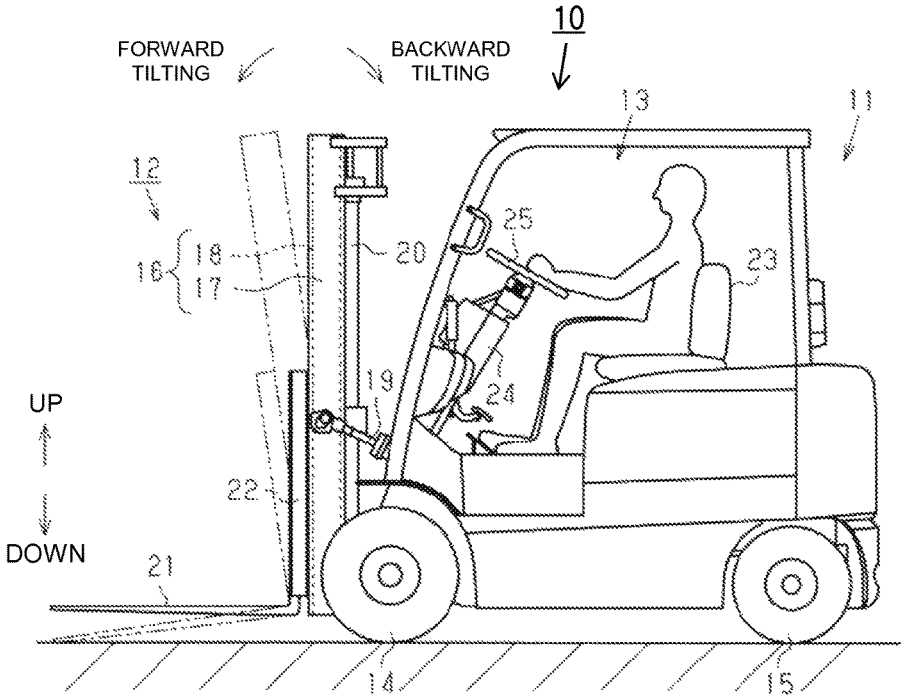
FIG. 1 is a side view of a forklift truck according to a first embodiment of the present invention.
Figure 2:
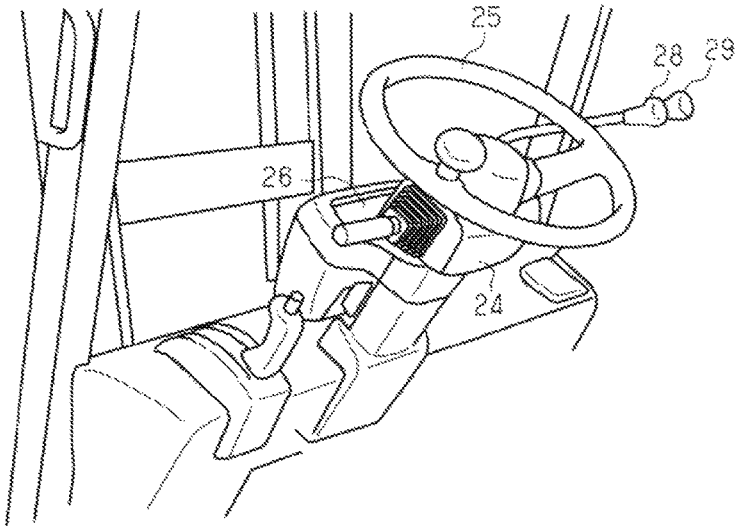
FIG. 2 is a perspective view of a cabin of the forklift truck of FIG. 1.

The following will describe an apparatus for controlling a load handling device according to a first embodiment of the present invention with reference to the accompanying drawings. Referring to FIGS. 1 and 2, the forklift truck as an industrial vehicle of the present invention, which is designated generally by 10, includes a vehicle body 11 and a load handling device 12 installed to the front of the vehicle body 11. The vehicle body 11 has in the center thereof a cabin 13. Drive wheels (front wheels) 14 and steerable wheels (rear wheels) 15 are provided in the front lower part and the rear lower part of the vehicle body 11, respectively. A drive source, such as an engine or a traction motor, is accommodated in the vehicle body 11 and coupled to the drive wheels 14 to drive the drive wheels 14.

The load handling device 12 includes a mast assembly 16 that is vertically provided at the front of the vehicle body 11. The mast assembly 16 includes a pair of right and left outer masts 17 and a pair of right and left inner masts 18, forming a multi-stage mast assembly (two-stage mast assembly in the first embodiment). Each outer mast 17 is connected with its hydraulic tilt cylinder 19 that causes the outer mast 17 to tilt forward and backward with respect to the vehicle body 11. Each inner mast 18 is connected with its hydraulic lift cylinder 20 that causes the inner mast 18 to slide up and down in its corresponding outer mast 17. A pair of forks 21 is mounted to the mast assembly 16 through a lift bracket 22 that is mounted to the inner masts 18 such that the lift bracket 22 is movable up and down. A load handling operation (loading and unloading of a load) herein refers to picking up a pallet (not shown) having thereon a load and placing the pallet to a predetermined position. The inner masts 18 are moved up and down along the outer masts 17 by the operation of the lift cylinder 20 to thereby move up and down the forks 21 together with the lift bracket 22. The forks 21 are tiltable forward and backward with the mast assembly 16 according to the operation of the tilt cylinder 19.

The cabin 13 has therein an operator's seat 23 on which an operator of the forklift truck 10 may be seated. A steering column 24 is provided in front of the operator's seat 23 in the cabin 13. The steering column 24 is provided at the top thereof with a steering wheel 25. The traveling direction of the forklift truck 10 is changed by changing the steering angle of the steerable wheel 15 with the steering wheel 25. A display device 26 is mounted to the steering column 24. The display device 26 shows by image various information of the forklift truck 10 (e.g. the vehicle speed and some error information).

A lift lever 28 and a tilt lever 29 are provided on the right of the steering column 24. The lift lever 28 is operated to lift the load handling device 12 (the forks 21). The tilt lever 29 is operated to tilt the load handling device 12 (the mast assembly 16) forward and backward. The lift lever 28 and the tilt lever 29 of the first embodiment correspond to the load handling lever of the present invention. The lift lever 28, which is normally placed in the neutral position, is tiltable to a position directing lifting or lowering of the forks 21. The lift cylinder 20 is operated (extended or retracted) according to the direction to which the lift lever 28 is moved. When the lift lever 28 at the lifting or the lowering position is returned to the neutral position, the motion of the lift cylinder 20 is stopped with the forks 21 at the lifted or lowered position. When the lift lever 28 is at the neutral position, no instruction is made to lift or lower the forks 21.

The tilt lever 29, which is normally placed in the neutral position, is tiltable to a position directing tilting forward or backward. The tilt cylinder 19 is operated (extended or retracted) according to the direction to which the tilt lever 29 is operated. When the tilt lever 29 at a position directing tilting the mast assembly 16 forward or backward is returned to the neutral position, the motion of the tilt cylinder 19 is stopped at the forward or backward tilted position. When the tilt lever 29 is at the neutral position, no instruction is made to the mast assembly 16 to tilt forward or backward.

Figure 3:
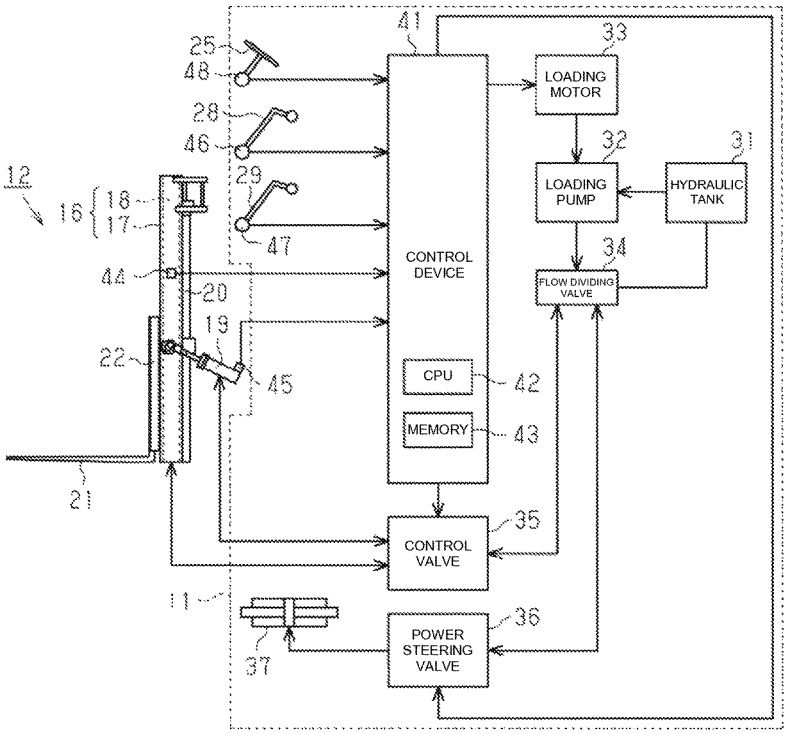
FIG. 3 is a block diagram showing a configuration of the forklift truck according to the first embodiment of the present invention.

As shown in FIG. 3, the vehicle body 11 has therein a hydraulic tank 31 that holds therein hydraulic oil and a loading pump 32 that pumps the hydraulic oil from the hydraulic tank 31. The loading pump 32 is connected with a loading motor 33 as a motor of the present invention that drives the loading pump 32. Thus, the loading motor 33 functions as the drive of the present invention that drives the loading pump 32. In the first embodiment the flow rate of hydraulic oil that is pumped by the loading pump 32 is varied in accordance with the drive amount of the loading motor 33, that is, the rotation speed of the loading motor 33. A flow dividing valve 34 that divides flow of hydraulic oil is connected, on one hand, with the loading pump 32 and, on the other hand, to a control valve 35 and a power steering valve 36. A priority valve is used for the flow dividing valve 34. The hydraulic oil supplied to the flow dividing valve 34 from the loading pump 32 is preferentially supplied to the power steering valve 36. Specifically, the hydraulic oil supplied to the flow dividing valve 34 is supplied to the power steering valve 36 at a predetermined flow rate, and the control valve 35 is supplied with hydraulic oil at a flow rate that corresponds to the difference between the flow rate of the hydraulic oil supplied to the flow dividing valve 34 and the flow rate of the hydraulic oil supplied to the power steering valve 36. In other words, the power steering valve 36 is supplied with hydraulic oil at a predetermined flow rate irrespective of the delivery of the loading pump 32, that is, irrespective of the rotation speed of the loading motor 33.

The control valve 35 is connected with the tilt cylinder 19 and the lift cylinder 20. The control valve 35 controls the flow rate of hydraulic oil supplied to the tilt cylinder 19 and the lift cylinder 20, respectively. The tilt cylinder 19 and the lift cylinder 20 are driven at a speed according to the amount of hydraulic oil supplied per a predetermined unit of time, respectively.

A steering cylinder 37 is connected to the power steering valve 36. The power steering valve 36 controls the flow rate of hydraulic oil supplied to two hydraulic chambers formed on opposite sides of a piston of the steering cylinder 37.

The vehicle body 11 further has therein a control device 41 that controls the loading motor 33, the control valve 35, and the power steering valve 36. It is to be noted that the control device 41 corresponds to the controller of the present invention. In the first embodiment, the control device 41 controls the loading motor 33, the control valve 35 and the power steering valve 36 according to the operation amount of the lift lever 28, the operation amount of the tilt lever 29, the operation amount of the steering wheel 25, the tilt angle of the load handling device 12, and the lifted height of the forks 21 of the load handling device 12, the detailed description of which will be made hereafter.

The control device 41 has therein a CPU (central processing unit) 42 that is configured to execute a control operation according to a predetermined procedure and a readable and rewritable memory 43. The memory 43 stores therein a control program for controlling the traveling and load handling operation of the forklift truck 10. The forklift truck 10 according to the first embodiment is configured to regulate the speed of lifting the forks 21 by regulating the flow rate of hydraulic oil supplied to the lift cylinder 20 when the mast assembly 16 is tilted forward. Fort this purpose, the memory 43 of the first embodiment stores therein data of a forward tilt angle of the mast assembly 16 at which the speed of lifting the mast assembly 16 is regulated, and of regulation of flow of the flow rate of hydraulic oil supplied to the lift cylinder 20 in regulating the lifting speed of the mast assembly 16. The control device 41 is connected with a lifted height detection switch 44, a tilt angle sensor 45, a lift lever angle sensor 46, a tilt lever angle sensor 47, and a steering angle sensor 48.

The lifted height detection switch 44 as the lifted height detector of the present invention is provided in the mast assembly 16. The lifted height detection switch 44 detects a lifted height (a height position) of the forks 21. Upon detection of the forks 21 reaching a predetermined reference height (e.g. 2,000 mm), the lifted height detection switch 44 outputs a detection signal to the control device 41. An example of the lifted height detection switch 44 includes a limit switch. In the first embodiment, one lifted height detection switch 44 is provided in the mast assembly 16. In the following description of the embodiment, the height position that is higher than the above reference height or the height position of the forks 21 that is detected by the lifted height detection switch 44 that is higher than the reference height (e.g. 2,000 mm) is determined as a higher lifted height, and the height position that is equal to or lower than the reference height or the height position of the forks 21 detected by the lifted height detection switch 44 that is equal to or lower than the reference height is determined as a lower lifted height. Specifically, in the first embodiment, the reference height is determined by the lifted height detection switch 44. The lifted height detection switch 44 determines whether the forks 21 are at a lifted height that is higher than the reference height, that is, a higher lifted height, or at a lifted height that is equal to or lower than the reference height, that is, a lower lifted height, based on thus determined reference height. In other words, the detection of the forks 21 by the lifted height detection switch 44 is performed in a binary manner. Receiving a detection signal from the lifted height detection switch 44, the CPU 42 of the control device 41 determines that the forks 21 are currently at a higher lifted height with respect to the reference height. When no detection signal is sent from the lifted height detection switch 44, on the other hand, the CPU 42 determines that the forks 21 are at a lower lifted height with respect to the reference height.

The tilt angle sensor 45 as the tilt angle detector of the present invention is disposed in the vicinity of the tilt cylinder 19 and detects a tilt angle (a forward tilt angle or a backward tilt angle) of the mast assembly 16 with respect to the horizontal position of the forks 21 as a reference angle and outputs a detection signal that represents the detected tilt angle. An example of the tilt angle sensor 45 includes a potentiometer. Upon receiving the detection signal from the tilt angle sensor 45, the CPU 42 of the control device 41 determines the current tilt angle of the mast assembly 16.

The lift lever angle sensor 46 is mounted to the lift lever 28 and detects a lever angle (an operation amount) of the lift lever 28. The lift lever angle sensor 46 outputs a detection signal that represents the detected lever angle of the lift lever 28 to the control device 41. Receiving the detection signal from the lift lever angle sensor 46, the CPU 42 of the control device 41 determines the current lever angle of the lift lever 28.

The tilt lever angle sensor 47 is mounted to the tilt lever 29 and detects a lever angle (an operation amount) of the tilt lever 29. The tilt lever angle sensor 47 outputs a detection signal that represents the detected lever angle of the tilt lever 29 to the control device 41. Upon receiving the detection signal from the tilt lever angle sensor 47, the CPU 42 of the control device 41 determines the current lever angle of the tilt lever 29.

The steering angle sensor 48 is mounted to the steering wheel 25 and detects a steering angle (an operation amount) of the steering wheel 25. The steering angle sensor 48 outputs a detection signal that represents the detected steering angle of the steering wheel 25 to the control device 41. Receiving the detection signal from the steering angle sensor 48, the CPU 42 of the control device 41 determines the current steering angle of the steering wheel 25.

The control device 41 calculates flow rate of hydraulic oil (the amount of hydraulic oil supplied per a predetermined unit of time) required for performing an operation instructed by an operator based on the current lever angle of the lift lever 28 (or the operation amount of the lift lever 28), the current lever angle of the tilt lever 29 (or the operation amount of the tilt lever 29), and the current steering angle of the steering wheel 25. The control device 41 then controls the rotation speed of the loading motor 33 so that the flow dividing valve 34 is supplied with hydraulic oil at the calculated flow rate and regulates the flow rate of hydraulic oil supplied to the respective cylinders 19, 20, 37 through the control valve 35 and the power steering valve 36. Each cylinder is driven at a speed corresponding to the amount of hydraulic oil supplied per a predetermined unit of time to the cylinder. The lift cylinder 20 is supplied with hydraulic oil at a flow rate that is determined by the current lever angle of the lift lever 28 and lifts and lowers the forks 21 at a speed determined by the flow rate of hydraulic oil supplied to the lift cylinder 20. The tilt cylinder 19 is supplied with hydraulic oil at a flow rate that is determined by the current lever angle of the tilt lever 29 and tilts the mast assembly 16 forward or backward at a speed that is determined by flow rate of hydraulic oil supplied to the tilt cylinder 19. In the first embodiment, it is so configured that, under certain conditions, the flow rate of hydraulic oil supplied to the lift cylinder 20 is regulated so that the lift cylinder 20 is supplied with hydraulic oil at a flow rate that is smaller than the flow rate of hydraulic oil that is determined based on the current lever angle of the lift lever 28. It is to be noted that in a state where the flow rate of hydraulic oil supplied to the lift cylinder 20 is regulated, the flow rate of hydraulic oil that is actually supplied to the lift cylinder 20 does not exceed the regulated flow rate irrespective of whether the requested flow rate of hydraulic oil determined by the operation amount of the lift lever 28 is greater than the regulated flow rate or not. Therefore, if the requested flow rate of hydraulic oil determined by the operation amount of the lift lever 28 is equal to or smaller than the regulated flow rate, hydraulic oil at the requested flow rate is supplied to the lift cylinder 20.

Figure 4:
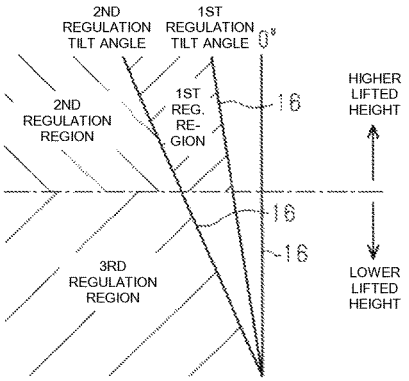
FIG. 4 is a schematic diagram showing regions in which the flow rate of hydraulic oil supplied to the lift cylinder of the forklift truck of FIG. 1 is regulated.

Conditions for regulating the flow rate of hydraulic oil supplied to the lift cylinder 20 will now be described with reference to FIG. 4. FIG. 4 schematically shows tilt angles of the mast assembly 16 of the forklift truck 10. In FIG. 4, the regions in which the flow rate of hydraulic oil supplied to the lift cylinder 20 is regulated are indicated by hatching. As described above, the tilt angle of the mast assembly 16 is zero degrees when the forks 21 are placed in horizontal position.

Referring to FIG. 4, when the forward tilt angle of the mast assembly 16 is equal to or smaller than a first regulation tilt angle, hydraulic oil is supplied to the lift cylinder 20 at a flow rate that is determined by the lever angle of the lift lever 28, so that the forks 21 are lifted at a speed determined by the operation amount of the lift lever 28. The first regulation tilt angle is greater than zero degrees, that is, the mast assembly 16 at the first regulation tilt angle is tilted forward in the vehicle body 11. To be more specific, the first regulation tilt angle is set at such an angle that the forklift truck 10 with the mast assembly 16 at a tilt angle equal to or smaller than the first regulation tilt angle will not suffer from operational instability irrespective of whether the forks 21 are lifted to a lower lifted height or a higher lifted height with respect to the reference height. The first regulation tilt angle, which may be established through experiment, is set at about one degree in the present embodiment.

When the forward tilt angle of the mast assembly 16 is greater than the first regulation tilt angle and equal to or smaller than a second regulation tilt angle that is greater than the first regulation tilt angle, and when the forks 21 are at a higher lifted height, the flow rate of hydraulic oil supplied to the lift cylinder 20 is regulated. On the other hand, when the forward tilt angle of the mast assembly 16 is greater than the first regulation tilt angle and equal to or smaller than the second regulation tilt angle, and when the forks 21 are at a lower lifted height, the flow rate of hydraulic oil supplied to the lift cylinder 20 is not regulated. In the following description, the region in which the forward tilt angle of the mast assembly 16 is greater than the first regulation tilt angle and equal to or smaller than the second regulation tilt angle and the lifted height of the forks 21 is higher than the reference height is referred to as a first regulation region. As mentioned earlier, the second regulation tilt angle of the mast assembly 16 is greater than the first regulation tilt angle, that is, the mast assembly 16 is tilted forward of the first regulation tilt angle. When the tilt angle of the mast assembly 16 is greater than the second regulation tilt angle, the tilt angle of the mast assembly 16 is set to an angle that may cause the forklift truck 10 suffer from operational instability irrespective of the lifted height of the forks 21. The second regulation tilt angle, which may be established through experiments, is set at two to four degrees in the present embodiment.

When the forward tilt angle of the mast assembly 16 is greater than the second regulation tilt angle, the flow rate of hydraulic oil supplied to the lift cylinder 20 is regulated irrespective of the lifted height of the forks 21. In the following description, a region in which the forward tilt angle of the mast assembly 16 is greater than the second regulation tilt angle and the forks 21 are at a higher lifted height will be referred to as a second regulation region, and a region in which the forward tilt angle of the mast assembly 16 is greater than the second regulation tilt angle and the forks 21 are at a lower lifted height will be referred to as a third regulation region.

Figure 5:
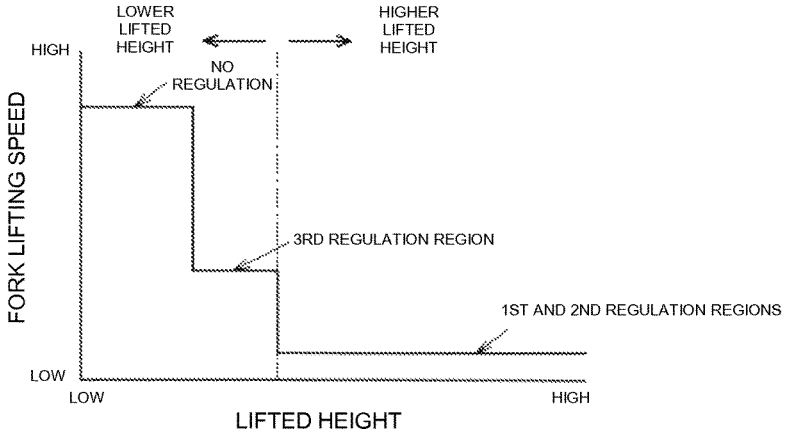
FIG. 5 is a graph showing controlling of the fork lifting speed in each of the regulation regions.

Referring to FIG. 5, in the third regulation region, regulation of the flow rate of hydraulic oil supplied to the lift cylinder 20 is performed. Specifically, the fork lifting speed in the third regulation region is less strict than in the first and the second regulation regions. When the flow rate regulation in the first and the second regulation regions is referred to as a first flow rate regulation, and the flow rate regulation in the third regulation region as a second flow rate regulation, respectively, hydraulic oil is allowed to be supplied to the lift cylinder 20 at a higher flow rate in the second flow rate regulation than in the first flow rate regulation. Accordingly, in the third regulation region, the lift cylinder 20 can be extended or moved faster than in the first and the second regulation regions.

The flow rate regulation in the third regulation region is set at, for example, about 40% of the flow rate of hydraulic oil supplied to the lift cylinder 20 when the lifting speed of the forks 21 is maximum, i.e., when the lift lever 28 is placed at the maximum lever angle.

The flow rate regulations set to the flow rate of hydraulic oil supplied to the lift cylinder 20 are substantially the same between the first regulation region and the second regulation region. The flow rate regulation, and hence the regulation of the fork lifting speed, in the first and the second regulation regions is set so that the extending speed of the lift cylinder 20 does not affect the load handling operation. Specifically, the flow rate regulation in the first and the second regions is set at, for example, about 20% of the flow rate of hydraulic oil supplied to the lift cylinder 20 when the fork lifting speed is maximum. The apparatus for controlling load handling device 12 according to the first embodiment is configured to include the lifted height detection switch 44 that detects the lifted height of the forks 21; the tilt angle sensor 45 that detects the tilt angle of the mast assembly 16; the loading pump 32 that pumps hydraulic oil from the hydraulic tank 31; the loading motor 33 that drives the loading pump 32; and the control device 41 that controls the drive amount of the loading pump 32 based on the detected lifted height of the forks 21 and the detected forward tilt angle of the mast assembly 16.

The following will describe the control executed by the control device 41 as well as the operation of the apparatus for controlling the load handling device 12 of the forklift truck 10 in the first embodiment. When the forks 21 are lifted from a lower lifted height to a higher lifted height with respect to the reference height, the lifted height detection switch 44 detects that the forks 21 have been lifted higher than the reference height and outputs a detection signal to the control device 41. The control device 41 then determines that the forks 21 are at a higher lifted height with respect to the reference height.

When the forward tilt angle of the mast assembly 16 is greater than the first regulation tilt angle and equal to or smaller than the second regulation tilt angle, the control device 41 is operated to regulate the flow rate of hydraulic oil supplied to the lift cylinder 20 upon detecting that the forks 21 are at a higher lifted height. Specifically, the flow rate regulation is performed by controlling the rotation speed of the loading motor 33 and the control valve 35 appropriately so that the flow rate of hydraulic oil supplied to the lift cylinder 20 does not exceed the regulated flow rate. If the flow rate of hydraulic oil supplied to the lift cylinder 20 that is determined based on the lever angle of the lift lever 28 is greater than the flow rate that is regulated by the control device 41, the control device 41 is operated to regulate the flow rate of hydraulic oil supplied to the lift cylinder 20 so that the flow rate of hydraulic oil supplied to the lift cylinder 20 becomes equal to or smaller than the flow rate that is regulated by the control device 41.

By regulating the flow rate of hydraulic oil supplied to the lift cylinder 20, the extending speed of the lift cylinder 20 is reduced as the lifted height of the forks 21 exceeds the reference height. The operator then noticing that the reduced lifting speed of the forks 21 against the current lever angle of the lift lever 28 is warned of a potentially hazardous situation associated with instability of the forklift truck 10. Even if the operator tilts the mast assembly 16 backward from the current tilt angle to a forward tilt angle that is equal to or smaller than the first regulation tilt angle, the regulation of the flow rate of hydraulic oil supplied to the lift cylinder 20 is maintained. The regulation may be canceled on a condition that the forward tilt angle of the mast assembly 16 becomes equal to or smaller than the first regulation tilt angle and the lift lever 28 and the tilt lever 29, i.e., all the levers are returned to their respective neutral positions.

Furthermore, when the control device 41 determines that the forks 21 are at a higher lifted height with respect to the reference height, if the flow rate of hydraulic oil supplied to the lift cylinder 20 determined by the lever angle of the lift lever 28 is equal to or smaller than the flow rate that is regulated by the control device 41, the control device 41 does not regulate the flow rate of hydraulic oil supplied to the lift cylinder 20, with the result that the lift cylinder 20 is supplied with hydraulic oil at a flow rate that is determined by the lever angle of the lift lever 28.

When the forks 21 at a lower lifted height are lifted to a higher lifted height with the forward tilt angle of the mast assembly 16 being greater than the second regulation tilt angle, the regulation of flow rate of hydraulic oil supplied to the lift cylinder 20 is effective for both cases when the forks 21 are at a lower lifted height and when the forks 21 are at a higher lifted height. The control device 41 then executes the same control as in the case where the forward tilt angle of the mast assembly 16 is greater than the first regulation tilt angle and equal to or smaller than the second regulation tilt angle, and the forks 21 are at a higher lifted height. When the mast assembly 16 at a forward tilt angle that is greater than the second regulation tilt angle is tilted backward to a forward tilt angle that is equal to or smaller than the second regulation tilt angle, and the forks 21 are moved from a higher lifted height to a lower lifted height at the angle, the regulation of the flow rate of hydraulic oil supplied to the lift cylinder 20 is maintained. The regulation may be canceled on a condition that the forward tilt angle of the mast assembly 16 is equal to or smaller than the second regulation tilt angle, the forks 21 are moved down to a lower lifted height, and, the lift lever 28 and the tilt lever 29, i.e., all the loading control levers are returned to their neutral positions. When the forward tilt angle of the mast assembly 16 is greater than the second regulation tilt angle, the flow rate regulation that is performed when the forks 21 are at a lower lifted height is less strict than the flow rate regulation performed when the forks 21 are at a higher lifted height. Therefore, in the case where the forks 21 are at a lower lifted height, the fork lifting speed may be higher than in the case where the forks 21 are at a higher lifted height.

Meanwhile, in order to warn the operator of the forklift truck 10 being subjected to operational instability, it may be contemplated to stop the supply of hydraulic oil to the lift cylinder 20 and hence to stop the fork lifting operation in each of the regulation regions. However, once the fork lifting operation is stopped, the forks 21 can only be lowered, so that there is a fear that versatile operation to meet various requirements may not be obtained. For example, if the fork lifting operation is stopped during load handling operation to place a load at a position that is slightly higher than the reference height, it is necessary for the operator to tilt the mast assembly 16 backward before lifting the forks 21. According to the first embodiment, however, reducing the fork lifting speed with the forks 21 being at a higher lifted height may prevent a shock resulting from the fork lifting operation, as well as warning the forklift truck operator of a potential instability of the forklift truck 10. Therefore, the load handling operation can be performed by the forklift truck 10 with a regulated fork lifting speed to meet various load handling requirements, while warning the operator of a potentially hazardous situation of the forklift truck 10.

The steering cylinder 37 that controls the traveling direction of the forklift truck 10, the lift cylinder 20 and the tilt cylinder 19 that control the load handling operation are supplied with hydraulic oil from the loading pump 32. In the case where hydraulic oil is supplied to the steering cylinder 37, the lift cylinder 20, and the tilt cylinder 19 from a pump such as the loading pump 32 as in the present embodiment, there is a necessity that the flow dividing valve 34 is provided to divide the flow of the hydraulic oil.

If the fork lifting operation needs to be stopped for warning the operator of a potential instability of the forklift truck 10, the loading pump 32 needs to be stopped to stop the supply of hydraulic oil to the lift cylinder 20. If the hydraulic oil supplied from the loading pump 32 to the flow dividing valve 34 should all be distributed to the power steering valve 36, it may be possible to stop the fork lifting operation without stopping the loading pump 32. However, as described earlier, the control valve 35 is supplied with hydraulic at a flow rate that corresponds to the difference between the flow rate of the hydraulic oil supplied to the flow dividing valve 34 and the flow rate of the hydraulic oil supplied preferentially to the power steering valve 36. Therefore, it is not practical to stop the fork lifting operation without stopping the loading pump 32. Furthermore, if the loading pump 32 is stopped to stop the fork lifting operation, the supply of hydraulic oil to the steering cylinder 37 is stopped accordingly, which disables the steering of the forklift truck 10 itself, as well as the fork lifting operation.

According to the first embodiment, regulation of the flow rate of hydraulic oil to the lift cylinder 20 permits the steering operation of the forklift truck 10 while regulating the fork lifting speed, without stopping supplying hydraulic oil to the lift cylinder 20.

According to the first embodiment, the following effects are obtained.

(1) When the forward tilt angle of the mast assembly 16 is greater than the first regulation tilt angle and the forks 21 are at a higher lifted height, the flow rate of hydraulic of supplied to the lift cylinder 20 is regulated to thereby regulate the fork lifting speed. Such regulation of the fork lifting speed informs the operator of the forklift truck 10 of a potential instability of the forklift truck 10 preliminarily while the operation of the forklift truck 10 is stable. That is, the operator may be prompted to tilt the mast assembly 16 backward while the operation of the forklift truck 10 is stable. Although the flow rate of hydraulic oil supplied to the lift cylinder 20 is regulated, the supply of hydraulic oil to the lift cylinder 20 is not stopped and, therefore, the fork lifting operation is not disturbed, so that the load handling operation may be continued with a reduced fork lifting speed as required by the operating condition.

(2) When the forward tilt angle of the mast assembly 16 is greater than the second regulation tilt angle, regulation of the flow rate of hydraulic oil supplied to the lift cylinder 20 is performed irrespective of the lifted height of the forks 21. When the forward tilt angle of the mast assembly 16 is greater than the second regulation tilt angle, by restricting the lifting speed of the forks 21 while the forks 21 are still at a lower height, the operator of the forklift truck 10 is made aware of a potential instability of the forklift truck 10 even though the forks 21 are at a lower lifted height.

(3) The configuration in which the loading pump 32 is driven by the loading motor 33 permits the loading pump 32 to vary its drive amount by changing the rotation speed of the loading motor 33.

(4) The use of a lifted height detection switch 44 as the lifted height detector of the present invention that simply detects whether the forks 21 are at a higher lifted height or a lower lifted height makes easy the control of the fork lifting speed.

(5) When the mast assembly 16 at a forward tilt angle greater than the first regulation tilt angle is tilted backward to a forward tilt angle equal to or smaller than the first regulation tilt angle, the regulation of the flow rate of hydraulic oil supplied to the lift cylinder 20 is not canceled unless the lift lever 28 and the tilt lever 29 are both returned to their neutral positions, so that the fork lifting speed will not be changed during the load handling operation.

(6) When the mast assembly 16 at a forward tilt angle greater than the second regulation tilt angle is tilted backward to a forward tilt angle equal to or smaller than the second regulation tilt angle and the forks 21 are moved from a higher lifted height to a lower lifted height at the angle, the regulation of the flow rate of hydraulic oil supplied to the lift cylinder 20 is not canceled unless the lift lever 28 and the tilt lever 29 are both returned to their neutral positions, so that the fork lifting speed will not be changed during the load handling operation.

(7) When the mast assembly 16 is tilted backward to an angle at which the flow rate of hydraulic oil supplied to the lift cylinder 20 is not regulated, the regulation is canceled on the condition that both of the lift lever 28 and the tilt lever 29 are returned to their neutral positions. Therefore, even if only the lift lever 28 is returned to the neutral position while the tilt lever 29 is kept operated, the regulation remains effective and, therefore, the speed of tilting the mast assembly 16 during the operation of the tilt lever 29 does not change.

(8) When the forward tilt angle of the mast assembly 16 is greater than the second regulation tilt angle, the regulation of the flow rate of hydraulic oil supplied to the lift cylinder 20 is less strict when the forks 21 are at a lower lifted height than when the forks 21 are at a higher lifted height. Therefore, the lifting speed of the forks 21 when the forks 21 are at a lower lifted height can be higher than that when the forks 21 are at a higher lifted height. Turning off of the ignition switch of the forklift truck 10 after a load handling operation is over is performed with the forks 21 placed on the ground. Accordingly, next time when the forklift truck 10 is used, the ignition switch is turned on and the load handling operation is started with the forks 21 being set on the ground. The forks 21 on the ground, or at a lower lifted height, may be lifted fast off from the ground for the subsequent load handling operation, which ensures the load handling efficiency of the forklift truck 10. Furthermore, the lifting speed of the forks 21 inserted into a pallet placed on the ground and having thereon a load may be fast, which also ensures the load handling efficiency of the forklift truck 10. Since the operational stability of the forklift truck 10 is ensured as long as the forks 21 are at a lower lifted height, the forks 21 at a lower lifted height may be lifted to a higher speed without a fear of the operational instability, as compared with the case of the forks 21 being at a higher lifted height.

Second Embodiment

The following will describe an apparatus for controlling a load handling device according to a second embodiment of the present invention. In the following description, the parts and elements common to the first embodiment will be denoted with the same numerals or symbols and the description thereof will be omitted.

Figure 6:
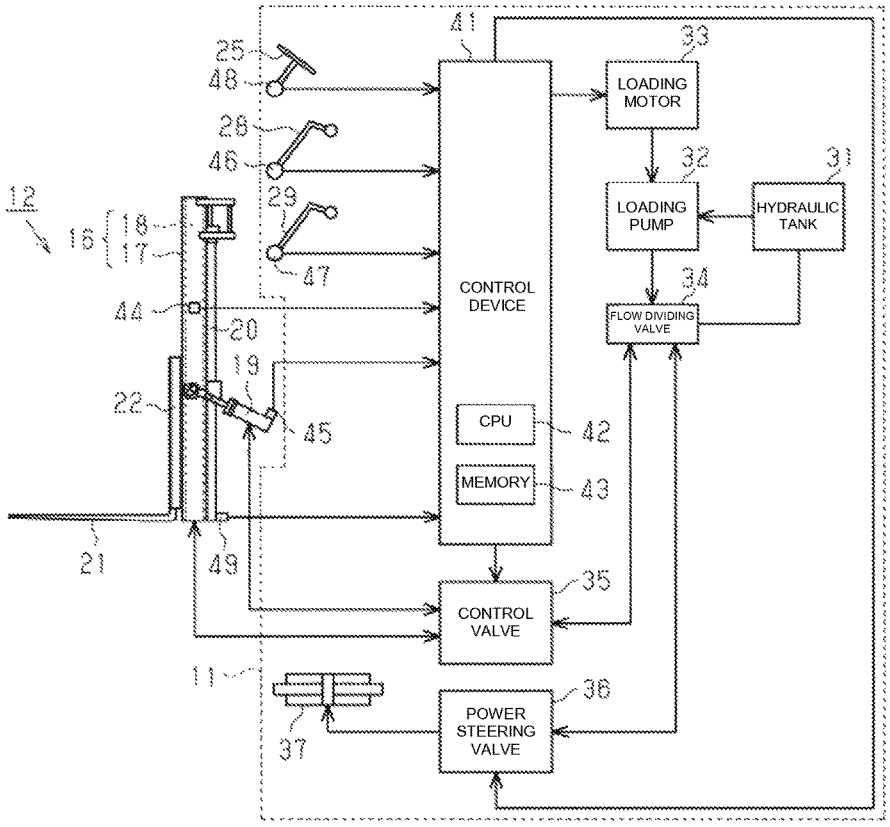
FIG. 6 is a block diagram showing a configuration of a forklift truck according to a second embodiment of the present invention.

As shown in FIG. 6, the vehicle body 11 of the forklift truck 10 is provided with a load sensor 49 that measures or detects a load applied to the forks 21. The load sensor 49 is disposed in a hydraulic circuit provided adjacent to the lower part of the lift cylinder 20. The load sensor 49 detects a hydraulic pressure of hydraulic oil in the lift cylinder 20 and outputs to the control device 41 a detection signal representing the load applied to the forks 21. An example of the load sensor 49 includes a pressure sensor. The CPU 42 of the control device 41 determines that the load is applied to the forks 21 based on the detection signal from the load sensor 49. The memory 43 of the control device 41 has stored therein data of a threshold against which determination of whether or not a load is applied to the forks 21 is made. The hydraulic pressure in the lift cylinder 20 tends to fluctuate and the reading of the load sensor 49 fluctuates, accordingly. Therefore, a first threshold and a second threshold are used for determining the state of the forks 21. The first threshold is used for determining a transition from a state that no load is applied to the forks 21 to a state that a load is applied to the forks 21, and the second threshold for determining a transition from a state that load a is applied to the forks 21 to a state that no load is applied to the forks 21.

Figure 7:
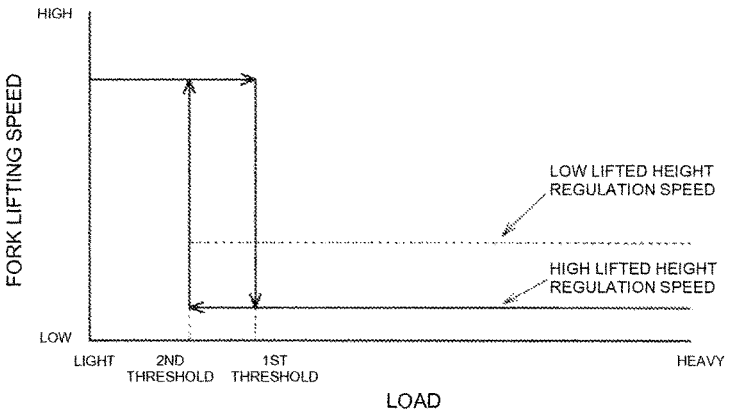
FIG. 7 is a graph showing a relationship between the load applied to the forks and the regulation of the fork lifting speed in the forklift truck of FIG. 6.

As shown in the graph of FIG. 7, the first threshold is set greater than the second threshold in terms of the load value in the horizontal axis of the graph. When the load that is less than the first threshold becomes the first threshold or higher, the control device 41 determines that a load is applied to the forks 21. Because the second threshold is set smaller than the first threshold in terms of the load value, even though the load measured by the load sensor 49 fluctuates in the range from the second threshold to less than the first threshold, or equal to or greater than the first threshold, it is determined that the forks 21 have thereon a load as long as the load detected by the load sensor 49 is equal to or greater than the second threshold.

When the load of a value equal to or greater than the first threshold becomes less than the second threshold, the control device 41 determines that no load is applied to the forks 21. Because the first threshold is greater than the second threshold in terms of the load value, even though the load detected by the load sensor 49 fluctuates in the range from less than the second threshold to equal to or greater than the second threshold, it is determined that the forks 21 have thereon no load as long as the load detected by the load sensor 49 is less than the first threshold. The control device 41 of the second embodiment corresponds to the determination device of the present invention that determines whether the forks 21 are loaded or not.

When it is determined by the control device 41 that no load is applied to the forks 21, the flow rate of hydraulic oil supplied to the lift cylinder 20 is not regulated and the lift cylinder 20 is supplied with hydraulic oil at a flow rate that is determined by the lever angle of the lift lever 28, irrespective of the lifted height of the forks 21 and the tilt angle of the mast assembly 16. When no load is applied to the forks 21, the possibility of hazardous situation of the forklift truck 10, such as the operational instability thereof is low, irrespective of the lifted height of the forks 21 and the forward tilt angle of the mast assembly 16 and, therefore, the flow rate of hydraulic oil supplied to the lift cylinder 20 is not regulated.

When it is determined by the control device 41 that a load is applied to the forks 21, the flow rate of hydraulic oil supplied to the lift cylinder 20 is regulated according to the lifted height of the forks 21 and the tilt angle of the mast assembly 16. The regulation is performed in the same manner as in the case of the first embodiment. Specifically, the low lifted height regulation speed in FIG. 7 is the fork lifting speed at which the flow rate of hydraulic oil supplied to the lift cylinder 20 and hence the extending speed of the lift cylinder 20 are regulated, corresponding to the third regulation region of FIG. 4. The high lifted height regulation speed in FIG. 7 is the fork lifting speed at which the flow rate of hydraulic oil supplied to the lift cylinder 20 and hence the extending speed of the lift cylinder 20 are regulated, corresponding to the second regulation region of FIG. 4.

According to the second embodiment, the following effects are obtained, in addition to the effects of the first embodiment.

(9) When it is determined by the load sensor 49 that no load is applied to the forks 21, the flow rate of hydraulic oil supplied to the lift cylinder 20 is not regulated. When no load is applied to the forks 21 and, therefore, the possibility of hazardous situation of the forklift truck 10 such as the operational instability thereof is low, the fork lifting speed need not be regulated, which ensures the load handling efficiency of the forklift truck 10.

The embodiments described above may be modified in various ways as exemplified below.

Figure 8:
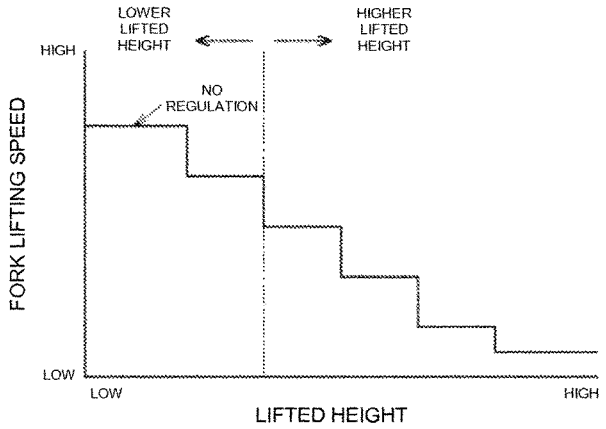
FIG. 8 is a graph showing a relationship between the lifted height of the forks and the regulation of the fork lifting speed in a forklift truck according a modification of the present invention.

In the first and the second embodiments, a switch that detects the lifted height of the forks 21 may continuously be used for the lifted height detection switch 44. In this case, it may be configured such that the regulation of the flow rate of hydraulic oil supplied to the lift cylinder 20 becomes stricter as the lifted height of the forks 21 increases. In other words, the fork lifting speed may be slowed sown with an increase of the lifted height of the forks 21. For example, as shown in FIG. 8, the fork lifting speed may be slowed down in a stepped manner as the lifted height of the forks 21 increases. Alternatively, the fork lifting speed may be decreased in a continuous manner.

In the first and the second embodiments, it may be configured such that setting of the first and the second regulation tilt angles are changeable according to the specifications of the forklift truck, the load capacity of the forklift truck, or the task to be handled by the forklift truck, and the like.

Figure 9:
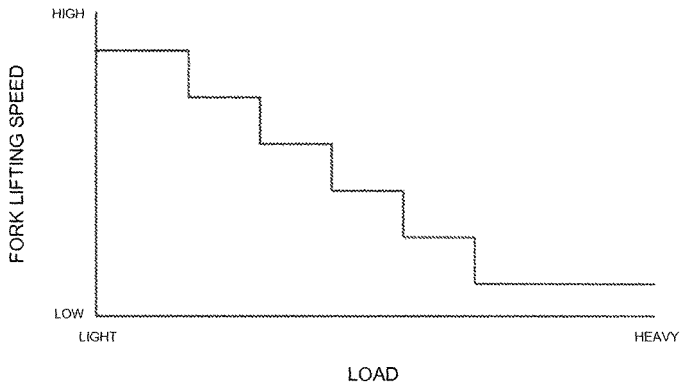
FIG. 9 is a graph showing a relationship between the load and the regulation of the fork lifting speed in the forklift truck of FIG. 8 according to the modification of the present invention.

In the second embodiment, it may be configured such that the regulation of the flow rate of hydraulic oil supplied to the lift cylinder 20 becomes stricter as the load applied to the forks 21 increases. For example, as shown in FIG. 9, the fork lifting speed may be slowed down in a stepped manner with an increase of the load applied to the forks 21. In this case, the threshold should be set for each of the loads according to which the value of the regulation of the flow rate of hydraulic oil supplied to the lift cylinder 20 is changed. As in the second embodiment, the first threshold is used for determining a transition from a state that no load is applied to the forks 21 to a state that a load is applied to the forks 21, and the second threshold for determining a transition from a state that a load is applied to the forks 21 to a state that no load is applied to the forks 21. Furthermore, the fork lifting speed may be decreased continuously as the load applied to the forks 21 increases.

In the second embodiment, it may be configured such that the fork lifting speed is varied according to the lifted height of the forks 21 and the load applied to the forks 21. Specifically, the memory 43 may have stored therein data of the regulation of the flow rate of hydraulic oil supplied to the lift cylinder 20 according to the lifted height of the forks 21 and the regulation according to the load applied to the forks 21. In lifting the forks 21, a two different regulations of the flow rate of hydraulic oil supplied to the lift cylinder 20, namely one regulation according to the lifted height of the forks 21 and the other regulation according to the load applied to the forks 21 are obtained and one regulation that causes the forks 21 to be lifted more slowly is selected to be used for controlling the load handling device. More specifically, the fork lifting speed according to the lifted height of the forks 21 in FIG. 8 and the fork lifting speed according to the load applied to the forks 21 in FIG. 9 are selectively used for the regulation of the flow rate of hydraulic oil supplied to the lift cylinder 20.

In the first and the second embodiments, it may be so configured that the display device 26 shows the operator of the forklift truck 10 a warning sign indicating that the regulation of the flow rate of hydraulic oil supplied to the lift cylinder 20 is effected and also prompting the operator to tilt the mast assembly 16 backward.

In the first and the second embodiments, a loading pump supplying hydraulic oil to the power steering valve 36 (or the steering cylinder 37) and a loading pump supplying hydraulic oil to the lift cylinder 20 and the tilt cylinder 19 (or the control valve 35) may be separately provided. In this case, the flow dividing valve 34 may not be provided.

The flow rate of hydraulic oil to be delivered from the loading pump 32 to the flow dividing valve 34 is controlled by the rotation speed of the loading motor 33. According to the present invention, however, the loading pump 32 may be substituted by a variable delivery pump which requires no changing of the rotation speed.

In the case of a forklift truck that is powered by an engine in which the drive wheels 14 are driven by the traction force of the engine, the engine may be used as the drive that drives the loading pump 32.

The forklift truck 10 may be provided with an inclinometer that measures the angle of a slope. When the fork lift truck 10 is on a slope, the forks 21 are lifted with the mast assembly 16 inclined with respect to the slope. Therefore, load handling operation on a slope can be performed appropriately by measuring an angle of the slope with the inclinometer and obtaining the angle of the mast assembly 16 to be tilted taking the angle of the slope into consideration.

The regulation of the flow rate of hydraulic oil supplied to the lift cylinder 20 may be the same in both of the case where the forward tilt angle of the mast assembly 16 is greater than the second regulation tilt angle and the forks 21 are at a higher lifted height and in the case where the forward tilt angle of the mast assembly 16 is greater than the second regulation tilt angle and the forks 21 are at a lower lifted height.

The forklift truck 10 may be provided with a lever for operating an attachment that is hydraulically driven as the load handling lever. Examples of an attachment include a fork side shifter adapted to change the spaced distance between the forks 21 and a roll clamp adapted to hold a roll of paper. In this case, the regulation of the flow rate of hydraulic oil supplied to the lift cylinder 20 may be cancelled by returning the lift lever 28, the tilt lever 29, and the lever for operating the attachment are returned to their neutral positions, as well as by tilting the mast assembly 16 backward to an angle that requires no regulation.

It may be configured such that the flow rate of hydraulic oil supplied to the tilt cylinder 19 and the flow rate of hydraulic oil supplied to the lift cylinder 20 are controlled individually. In this case, the regulation of the flow rate of hydraulic oil supplied to the lift cylinder 20 may be canceled on the condition that only the lift lever 28 is returned to its neutral position with the mast assembly 16 tilted backward to an angle at which the flow rate of hydraulic oil supplied to the lift cylinder 20 is not regulated. Since it may be so controlled that the flow rate of hydraulic oil supplied to the tilt cylinder 19 remains unchanged, the tilting speed of the mast assembly 16 remains unchanged without being influenced by the cancellation of the regulation.

What is claimed is:

1. An apparatus for controlling a load handling device of an industrial vehicle including:

a lift cylinder that is supplied with hydraulic oil at a flow rate determined by an operation amount of a lift lever as a load handling lever and lifts and lowers the load handling device at a lifting speed determined by the flow rate of hydraulic oil supplied to the lift cylinder; and a tilt cylinder that is supplied with hydraulic oil at a flow rate determined by an operation amount of a tilt lever as a load handling lever and tilts the load handling device at a tilting speed determined by the flow rate of hydraulic oil supplied to the tilt cylinder, the apparatus that controls the supply of hydraulic oil to the lift cylinder and the tilt cylinder comprising:

a lifted height detector that detects a lifted height of the load handling device;

a tilt angle detector that detects a tilt angle of the load handling device;

a loading pump that pumps hydraulic oil from a hydraulic tank provided in the industrial vehicle and supplies the hydraulic oil to the lift cylinder and the tilt cylinder;

a drive that drives the loading pump; and a controller configured to control the flow rate of hydraulic oil supplied to the lift cylinder and the tilt cylinder, the controller being configured to determine, in accordance with the forward tilt angle and the lifted height of the load handling device, a regulated flow rate of hydraulic oil supplied to the lift cylinder that is smaller than a flow rate based on a maximum operation amount of the lift lever, wherein when the forward tilt angle of the load handling device is greater than a first regulation tilt angle and the lifted height of the load handling device is higher than a predetermined reference height, the controller is configured to set the regulated flow rate as a maximum flow rate of hydraulic oil supplied to the lift cylinder and to regulate the flow rate of hydraulic oil supplied to the lift cylinder so that the flow rate of hydraulic oil supplied to the lift cylinder becomes equal to or smaller than the regulated flow rate so that the lifting speed of the load handling device is reduced.

2. The apparatus for controlling the load handling device according to claim 1, wherein when the forward tilt angle of the load handling device is greater than a second regulation tilt angle that is greater than the first regulation tilt angle, the controller is further configured to regulate the flow rate of hydraulic oil supplied to the lift cylinder irrespective of the lifted height of the load handling device.

3. The apparatus for controlling the load handling device according to claim 2, wherein the controller is further configured to regulate less strictly the flow rate of hydraulic oil supplied to the lift cylinder when the lifted height of the load handling device is equal to or lower than the reference height than when the lifted height of the load handling device is higher than the reference height.

4. The apparatus for controlling the load handling device according to claim 1, wherein the drive is a motor.

5. The apparatus for controlling the load handling device according to claim 1, wherein the lifted height detector detects whether the load handling device is at a higher lifted height which is higher than the reference height or at a lower lifted height which is equal to or lower than the reference height.

6. The apparatus for controlling the load handling device according to claim 1, wherein when the load handling device at a forward tilt angle that is greater than the first regulation tilt angle and at a lifted height that is higher than the reference height is tilted backward to a forward tilt angle that is equal to or smaller than the first regulation tilt angle, the controller is further configured to cancel the regulation of the flow rate of hydraulic oil supplied to the lift cylinder on a condition that the lift lever is returned to a neutral position.

7. The apparatus for controlling the load handling device according to claim 6, wherein the controller is further configured to cancel the regulation of the flow rate of hydraulic oil supplied to the lift cylinder on a condition that all the load handling levers are returned to the neutral positions.

8. The apparatus for controlling the load handling device according to claim 1, wherein when the load handling device at a forward tilt angle that is greater than the second regulation tilt angle is tilted backward to a forward tilt angle that is equal to or smaller than the second regulation tilt angle and at a lifted height that is equal to or lower than the reference height, the controller is further configured to cancel the regulation of the flow rate of hydraulic oil supplied to the lift cylinder on a condition that the lift lever is returned to a neutral position.

9. The apparatus for controlling the load handling unit according to claim 1, further comprising:

a load sensor that measures a load applied to the load handling device; and a determination device that determines whether or not a load is applied to the load handling device based on the load measured by the load sensor, wherein when it is determined by the determination device that no load is applied to the load handling device, the controller is configured to supply hydraulic oil to the lift cylinder at the flow rate determined by the operation amount of the lift lever irrespective of the lifted height and the forward tilt angle of the load handling device.

10. The apparatus for controlling the load handling device according to claim 1, wherein the industrial vehicle includes a steering cylinder that controls a traveling direction of the industrial vehicle, and wherein hydraulic oil is supplied from the loading pump to the steering cylinder, the lift cylinder, and the tilt cylinder through a flow dividing valve.

* * * * *